US006346863B2

(12) United States Patent
Sasaki et al.

(10) Patent No.: US 6,346,863 B2
(45) **Date of Patent: *Feb. 12, 2002**

(54) DIRECTIONAL COUPLER

(75) Inventors: Yutaka Sasaki, Nagaokakyo; Hiroaki Tanaka, Osaka-fu, both of (JP)

(73) Assignee: Murata Manufacturing Co., Ltd., Nagaokakyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/205,864

(22) Filed: Dec. 4, 1998

(30) Foreign Application Priority Data

Dec. 5, 1997 (JP) ..... 9-335821

(51) Int. Cl.[7] ..... H01P 5/18
(52) U.S. Cl. ..... 333/116; 333/117
(58) Field of Search ..... 333/116, 115, 333/112, 117, 118

(56) References Cited

U.S. PATENT DOCUMENTS 3,999,150 A * 12/1976 Caragliano et al. ..... 333/116
4,777,458 A * 10/1988 Pardini ..... 333/112
5,818,308 A * 10/1998 Tanaka et al. ..... 333/26 X

FOREIGN PATENT DOCUMENTS

JP 2839874 4/1979

OTHER PUBLICATIONS

W. P. O'Reilly, "Transmitter Power Amplifier Design–4", Wireless World, vol. 82, No. 1481, Jan. 1976, pp. 61–65, Fig. 5A.

European Search Report dated Mar. 10, 1999.

* cited by examiner

*Primary Examiner*—Benny Lee
(74) *Attorney, Agent, or Firm*—Ostrolenk, Faber, Gerb & Soffen, LLP

(57) ABSTRACT

First and second microstriplines disposed substantially in parallel to each other and coupled with each other are formed spirally in a substantially quadrangular shape with the first microstripline being disposed inside. The space between the first and second microstriplines is set at least partly wider than the space between the adjacent turns of the pair of first and second microstriplines.

2 Claims, 4 Drawing Sheets

DIRECTIONAL COUPLER

BACKGROUND OF THE INVENTION

1. Field of the Invention

The present invention relates to directional couplers, and more particularly, to a directional coupler for use in a mobile communication apparatus.

2. Description of the Related Art

FIG. 4 shows a conventional directional coupler. In FIG. 4, a directional coupler 20 is formed of a first microstripline 21 serving as a first distributed-constant line and a second microstripline 22 serving as a second distributed-constant line disposed substantially in parallel to each other, coupled with each other, and formed spirally in a substantially quadrangular shape with the first microstripline 21 being disposed inside of the second microstripline 22. The first microstripline 21 is connected to an input electrode 23 at one end thereof and to an output electrode 25 at the other end thereof. The second microstripline 22 is connected to an output electrode 24 at one end thereof and to an isolation electrode 26 at the other end thereof. The space g4 between the first and second microstriplines 21 and 22 disposed adjacently with the same number of turns is set narrower than the space d4 between the adjacent turns of the pair of first and second microstriplines 21 and 22. The lengths of the first and second microstriplines 21 and 22 are set substantially equal to one fourth the wavelength at the target frequency.

When a signal is input to the input electrode 23 with a terminating resistor (not shown) being connected to the isolation electrode 26 in the directional coupler 20 configured as described above, two signals with a phase difference of approximately 90 degrees are obtained from the output electrodes 24 and 25 at substantially the same amplitude level.

In the conventional case, however, the second microstripline 22 is longer than the first microstripline 21 by the lengths of several corners. Therefore, the phase difference between the two outputs of the directional coupler 20 shifts from the ideal state, namely, 90 degrees.

SUMMARY OF THE INVENTION

Accordingly, it is an object of the present invention to provide a directional coupler in which a shift of the phase difference between two outputs from 90 degrees can be reduced.

The foregoing object is achieved according to the present invention through the provision of a directional coupler in which first and second distributed-constant lines disposed substantially in parallel to each other and coupled with each other are formed spirally with the first distributed-constant line being disposed inside of the second distributed-constant line, wherein the space between the first and second distributed-constant lines disposed adjacently with the same number of turns is set wider than the space between the adjacent turns of the pair of first and second distributed-constant lines.

The directional coupler according to the present invention may also be provided with only a portion where the space between the first and second distributed-constant lines disposed adjacently with the same number of turns is set wider than the space between the adjacent turns of the pair of first and second distributed-constant lines.

With such a configuration, a deviation from 90 degrees of the phase difference between two outputs can be reduced in a directional coupler according to the present invention.

According to a directional coupler of the present invention, since the first and second distributed-constant lines disposed substantially in parallel to each other and coupled with each other are formed with the first distributed-constant line being disposed inside of the second distributed-constant line; and the space between the first and second microstriplines disposed adjacently with the same number of turns is made at least partially wider than the space between the adjacent turns of the pair of first and second microstriplines; a shift of the phase difference between the two outputs of the directional coupler from 90 degrees is made small, and the frequency band width of the directional coupler is made wide. In addition, with this structure, the space between the first and second microstriplines disposed adjacently with the same number of turns can be changed in a wide range, and the coupling degree of the directional coupler becomes easier to adjust.

DESCRIPTION OF THE PREFERRED EMBODIMENTS

Figure 1:
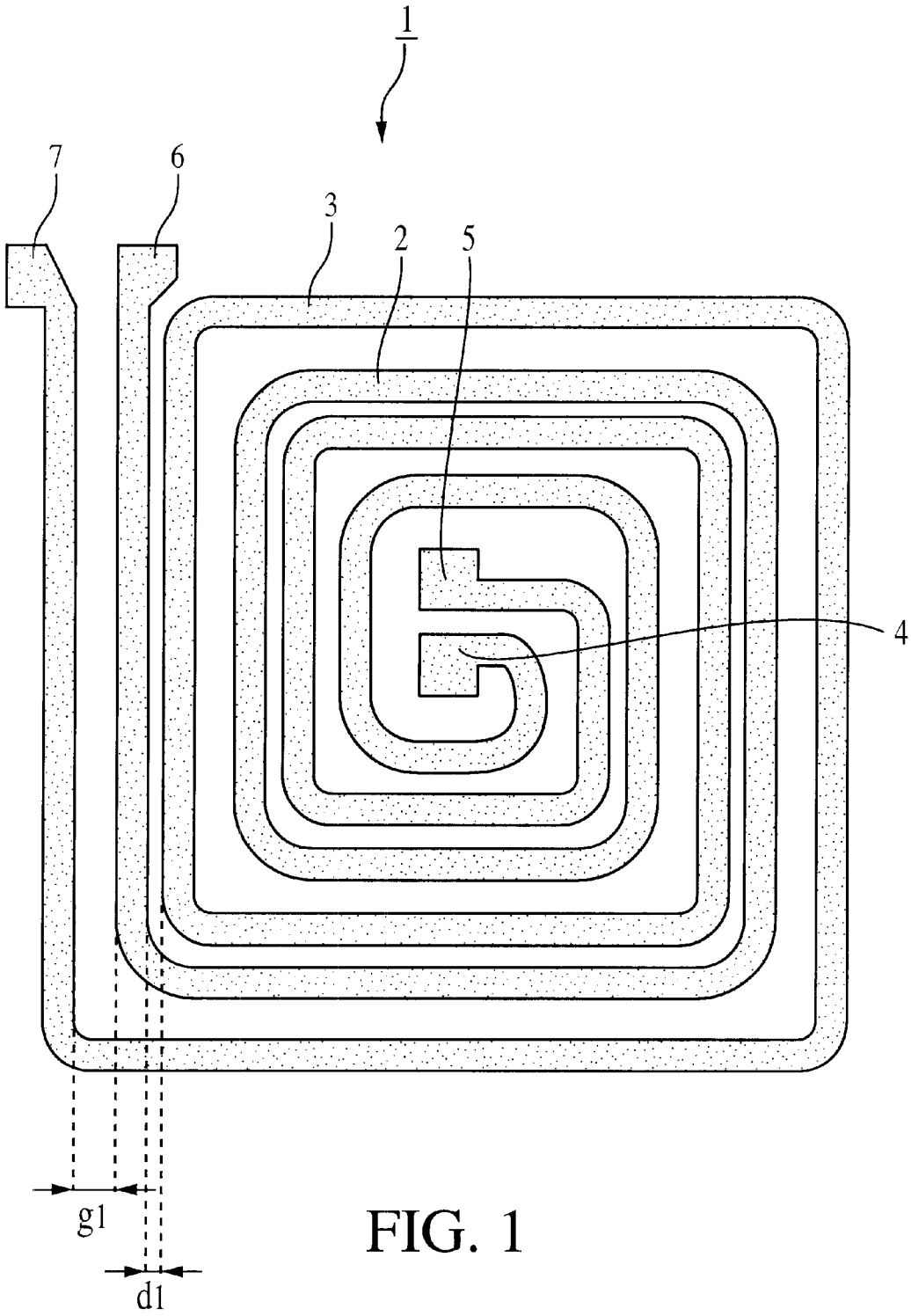
FIG. 1 is a view showing a configuration of a directional coupler according to an embodiment of the present invention.

FIG. 1 shows a directional coupler according to an embodiment of the present invention. In FIG. 1, a directional coupler 1 is formed of a first microstripline 2 serving as a first distributed-constant line and a second microstripline 3 serving as a second distributed-constant line disposed substantially in parallel to each other, coupled with each other, and formed spirally in a substantially quadrangular shape with the first microstripline 2 being disposed inside of the second microstripline 2. The first microstripline 2 is connected to an input electrode 4 at one end thereof and to an output electrode 6 at the other end thereof. The second microstripline 3 is connected to an output electrode 5 at one end thereof and to an isolation electrode 7 at the other end thereof. The space g1 between the first and second microstriplines 2 and 3 disposed adjacently with the same number of turns is set wider than the space d1 between the adjacent turns of the pair of first and second microstriplines 2 and 3. The lengths of the first and second microstriplines 2 and 3 are set substantially equal to one fourth the wavelength at the target frequency.

When a signal is input to the input electrode 4 with a terminating resistor (not shown) being connected to the isolation electrode 7 in the directional coupler 1 configured as described above, two signals with a phase difference of approximately 90 degrees are obtained from the output electrodes 5 and 6 at substantially the same level.

Figure 2:
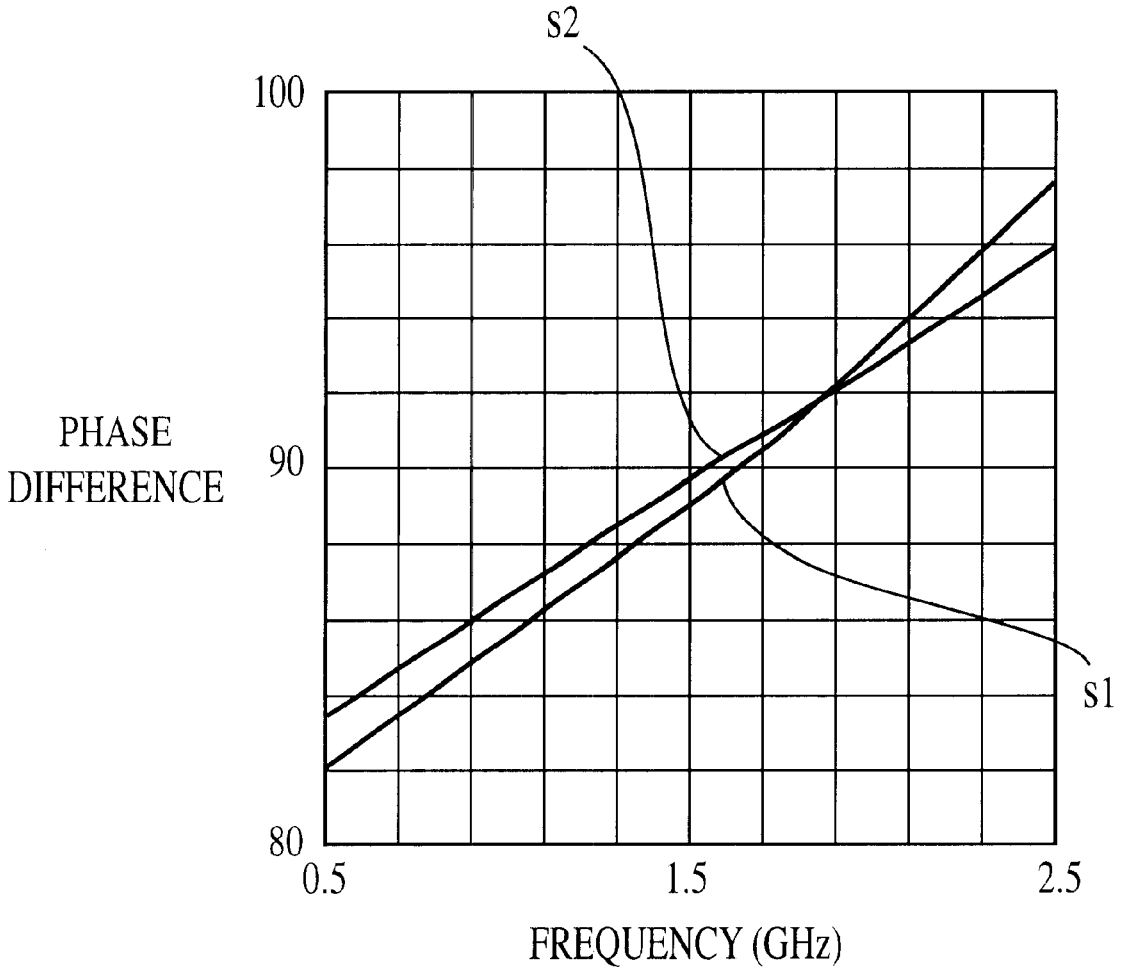
FIG. 2 is a view indicating the phase difference between two outputs of the directional coupler of FIG. 1.
Figure 4:
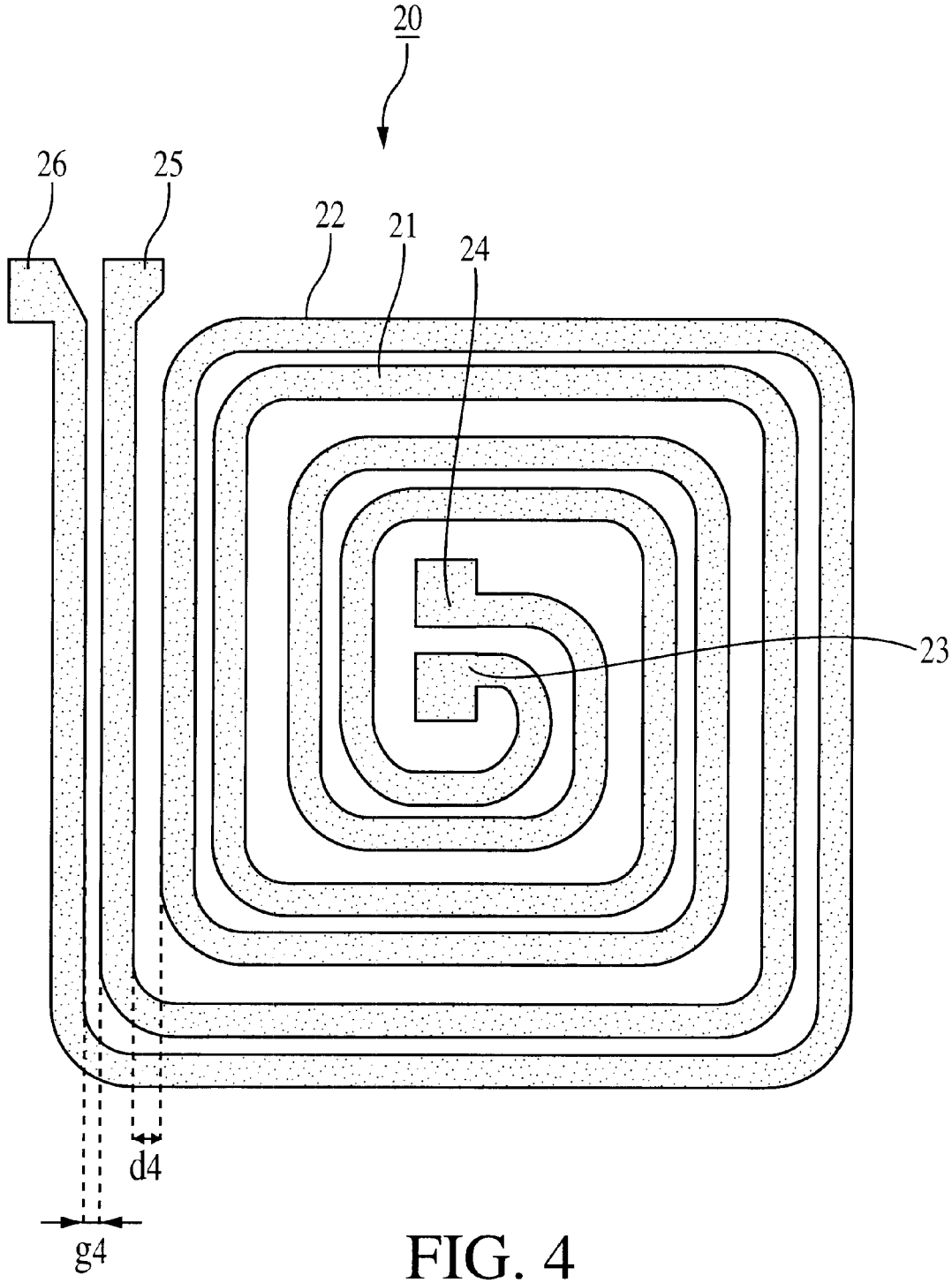
FIG. 4 PRIOR ART
FIG. 4 is a view of a configuration of a conventional directional coupler.

FIG. 2 shows the phase difference s2 between the two outputs of the directional coupler 1 shown in FIG. 1. For comparison, the phase difference s1 between the two outputs of the conventional directional coupler 20 shown in FIG. 4 is also shown. Both directional couplers are designed with a center frequency of 1.5 GHz. It is understood from FIG. 2 that the phase difference s2 between the two outputs is closer to 90 degrees than the phase difference s1, and is approximately 89 degrees. The gradient of a phase difference with respect to frequency is slightly gentler for the phase difference s2 than for the phase difference s1. This means that the directional coupler 1 maintains a phase difference of approximately 90 degrees over a wider frequency band than the directional coupler 20, and the directional coupler 1 operates as a wide-band directional coupler.

Since the phases of signals are shifted from each other between the adjacent turns of the pair of first and second microstriplines 2 and 3, even if the space d1 is made narrower, those signals are unlikely to be coupled with each other. This, by making the space d1 narrower, the space g1 between the first and second microstriplines 2 and 3 disposed adjacently with the same number of turns can be changed in a wider range without changing the overall size of the directional coupler, and the coupling degree of the directional coupler 1 becomes easier to adjust.

As described above, according to the directional coupler 1 of the present invention, the space g1 between the first and second microstriplines 2 and 3 disposed adjacently with the same number of turns is made wider than the space d1 between the respective turns of the pair of first and second microstriplines 2 and 3, and thereby a deviation from the desired phase difference, that is 90 degrees of phase difference, between the two outputs of the directional coupler 1 from 90 degrees is made small. In addition, the frequency band of the directional coupler is made wide and the coupling degree thereof becomes easier to adjust.

Figure 3:
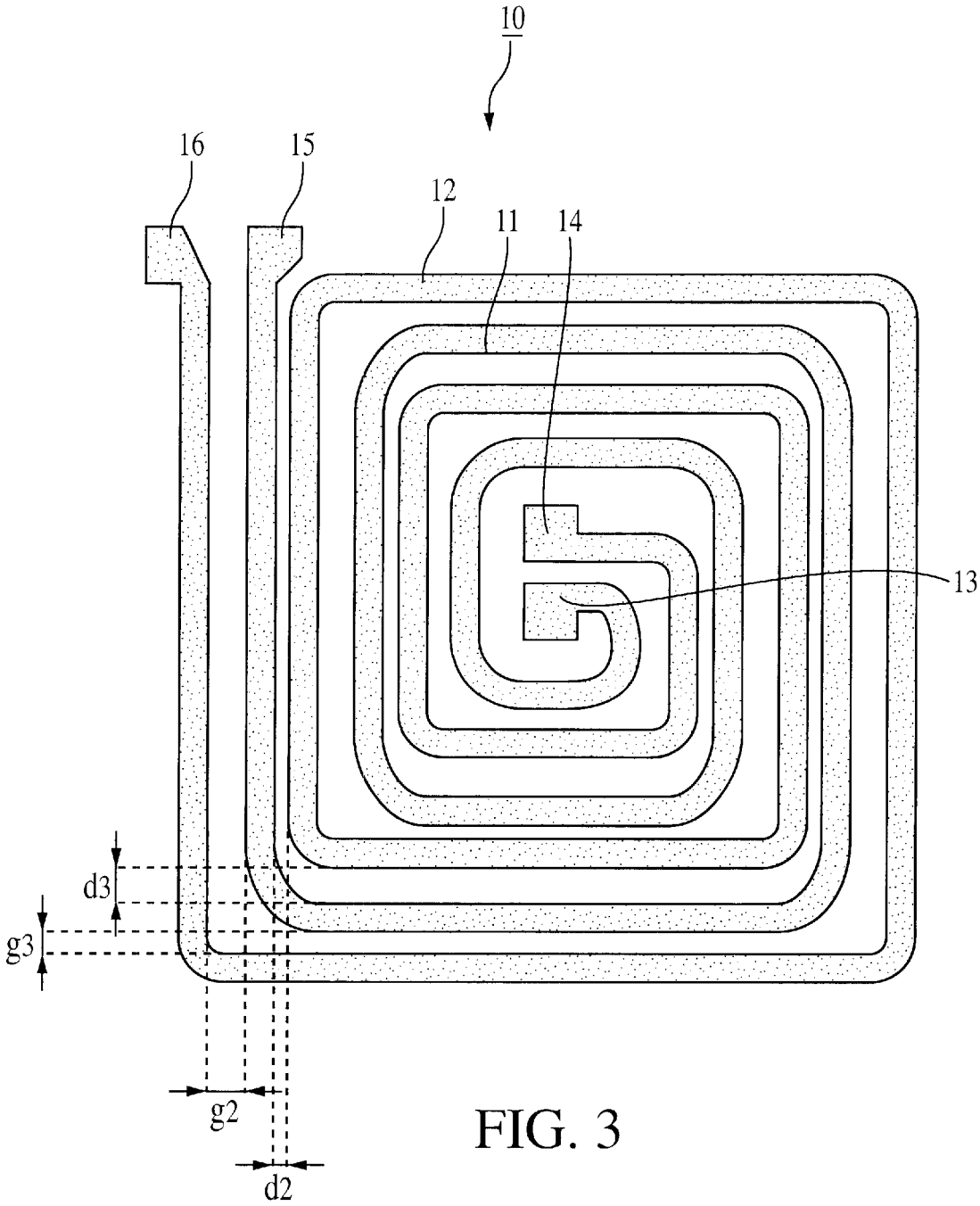
FIG. 3 is a view showing a configuration of another directional coupler according to an embodiment of the present invention.

FIG. 3 shows a directional coupler according to another embodiment of the present invention. In FIG. 3, a directional coupler 10 is formed of a first microstripline 11 serving as a first distributed-constant line and a second microstripline 12 serving as a second distributed-constant line disposed substantially in parallel to each other, coupled with each other, and formed spirally in a substantially quadrangular shape with the first microstripline 11 being disposed inside of the second microstripline 12. The first microstripline 11 is connected to an input electrode 13 at one end thereof and to an output electrode 15 at the other end thereof. The second microstripline 12 is connected to an output electrode 14 at one end thereof and to an isolation electrode 16 at the other end thereof. In the vertical direction in FIG. 3, the space g2 between the first and second microstriplines 11 and 12 disposed adjacently with the same number of turns is set wider than the space d2 between the adjacent turns of the pair of first and second microstriplines 11 and 12 However, in the horizontal direction in FIG. 3, the space g3 between the first and second microstriplines 11 and 12 disposed adjacently with the same number of turns is set narrower than the space d3 between the adjacent turns of the pair of first and second microstriplines 11 and 12. The lengths of the first and second microstriplines 11 and 12 are set substantially equal to one fourth the wavelength at the target frequency. Since the operation of the directional coupler 10 is the same as that of the directional coupler 1 shown in FIG. 1, the description thereof is omitted.

As described above, the space between the first and second microstriplines disposed adjacently with the same number of turns is made partially wider than the space between the adjacent turns of the pair of first and second microstriplines, and thereby a shift of the phase difference between the two outputs of the directional coupler 10 from 90 degrees is made small, as in the case shown in FIG. 1. In addition, the frequency band of the directional coupler is made wider.

In each of the above embodiments, the directional coupler is formed spirally in a substantially quadrangular shape. The shape is not limited to a substantial quadrangle. The same operation and advantages can be obtained with other shapes, such as a substantial polygon, a substantial circle, and a substantial ellipse.

In each of the above embodiments, among the two input electrodes, one is connected to a terminating resistor and a signal is input to the other. The connections may be reversed. In addition, the input electrodes and the output electrodes may be used vice versa. In other words, in each of the above embodiments, a signal may be input to either of the output electrodes to obtain two output signals from the input electrodes.

In each of the above embodiments, a microstripline is used as a distributed-constant line. Other distributed-constant lines such as a stripline may be used instead.

What is claimed is:

1. A directional coupler in which first and second distributed-constant lines are disposed substantially in parallel to each other and coupled with respect to each other and are spirally configured with the first distributed-constant line being disposed inside of the second distributed-constant line, wherein the space between the first and second distributed-constant lines over a part of their length is set wider than the space between the adjacent turns of the pair of first and second distributed-constant lines, and the space between the first and second distributed-constant lines over another part of their length is set narrower than the space between the adjacent turns of the pair of first and second distributed-constant lines.

2. A directional coupler, wherein:

first and second distributed-constant lines are disposed substantially in parallel to each other and coupled with respect to each other and are spirally configured with the first distributed-constant line being disposed inside of the second distributed-constant line;

wherein the space between the first and second distributed-constant lines over a part of their length is set wider than the space between the adjacent turns of the pair of first and second distributed-constant lines;

a first distance (g2) between a first portion of said first distributed constant line and a corresponding first portion of said second distributed constant line is wider than a second distance (d2) between adjacent turns of the pair of distributed-constant lines adjacent said first portions; and a third distance (g3) between a second portion of said first distributed constant line and a corresponding second portion of said second distributed constant line is narrower than a fourth distance (d3) between adjacent turns of the pair of distributed-constant lines adjacent said second portions.

* * * * *